United States Patent [19]

Lew

[11] 4,439,958

[45] Apr. 3, 1984

[54] PRESTRESSED SELF-INTERLOCKING GRILLE STRUCTURE

[76] Inventor: Hyok S. Lew, 7890 Oak St., Arvada, Colo. 80005

[21] Appl. No.: 276,956

[22] Filed: Jun. 24, 1981

Related U.S. Application Data

[63] Continuation-in-part of Ser. No. 58,556, Jul. 18, 1979, Pat. No. 4,282,695, and a continuation-in-part of Ser. No. 206,303, Nov. 12, 1980.

[51] Int. Cl.[3] ..... E04B 1/32

[52] U.S. Cl. ..... 52/86; 52/667; 52/668

[58] Field of Search ..... 52/664, 668, 667, 666, 52/665, 669, 80, 86

[56] References Cited

U.S. PATENT DOCUMENTS

| | | | |
|---|---|---|---|
| 51,328 | 12/1865 | Lockwood | 52/86 |
| 826,989 | 7/1906 | Von Busse | 52/668 |
| 928,196 | 7/1909 | Herald | 52/669 |
| 950,236 | 2/1910 | Melish | 52/669 |
| 1,336,547 | 4/1920 | Write | 52/669 |
| 2,069,391 | 2/1937 | Sample | 52/668 |
| 2,752,868 | 7/1956 | Blumfield | 52/86 |
| 4,282,695 | 8/1981 | Lew | 52/668 |

FOREIGN PATENT DOCUMENTS

| | | | |
|---|---|---|---|
| 484435 | 10/1929 | Fed. Rep. of Germany | 52/86 |
| 317297 | of 1934 | France | 52/668 |
| 340558 | 12/1930 | United Kingdom | 52/86 |
| 359322 | 10/1931 | United Kingdom | 52/669 |
| 2060752 | 5/1981 | United Kingdom | 52/63 |

*Primary Examiner*—Henry E. Raduazo

[57] ABSTRACT

This invention relates to a self-interlocking grille structure comprising a plurality of the bars curved to provide a required surface geometry, which bars including a series of notches and holes, and a plurality of rods wherein said plurality of bars are criss crossed to form a network of bars and said rods threaded through said holes in the bars criss cross each other forming a network of rods which network of rods is embedded into the network of the bars.

5 Claims, 14 Drawing Figures

PRESTRESSED SELF-INTERLOCKING GRILLE STRUCTURE

This is a Continuation-In-Part application to the patent applications entitled "Self-Interlocking Grille" of Ser. Nos. 6/058,556, now U.S. Pat. No. 4,282,695 and 6/206,303 filed on July 18, 1979 and Nov. 12, 1980, respectively.

A light weight structure that provides a skeleton structure for a thin skin which can be easily field-assembled without using a heavy erection equipment or special tools has been in great demand in view that such a structure can be very conveniently applied in constructing the light and transparent structures such as the green house and swimming pool cover. Such a structure has many applications in the residential, commercial and industrial buildings for the sky lights, window guards, partitioning panels, etc.

The primary object of the present invention is to provide the self-interlocking grille system that can be used as a supportive structure in constructing the green house, the swimming pool cover, the sky light, etc., to which a thin transparent skin can be attached.

Another object of the present invention is to provide a prestressed structure which provides an excellent rigidity.

A further object of the present invention is to provide a curved grille structure that can be field assembled without using any special tools and equipments.

Yet another object of the present invention is to provide a curved grille structure that does not require any weld connection to assemble.

Yet a further object of the present invention is to provide a grille structures for the shelters, skylights, window guards, etc., which has an eye-pleasing appearance.

Still another object of the present invention is to provide the strongest light weight structure pound for pound providing the skeleton structure to which a thin skin can be attached.

Still a further object of the present invention is to provide the grille structure including a facile means for attaching the skin into it.

These and other objects of the present invention will become clear as the description of the present invention proceeds. The present invention may be described with a greater clarity and specificity by referring to the following Figures.

Figure 1:
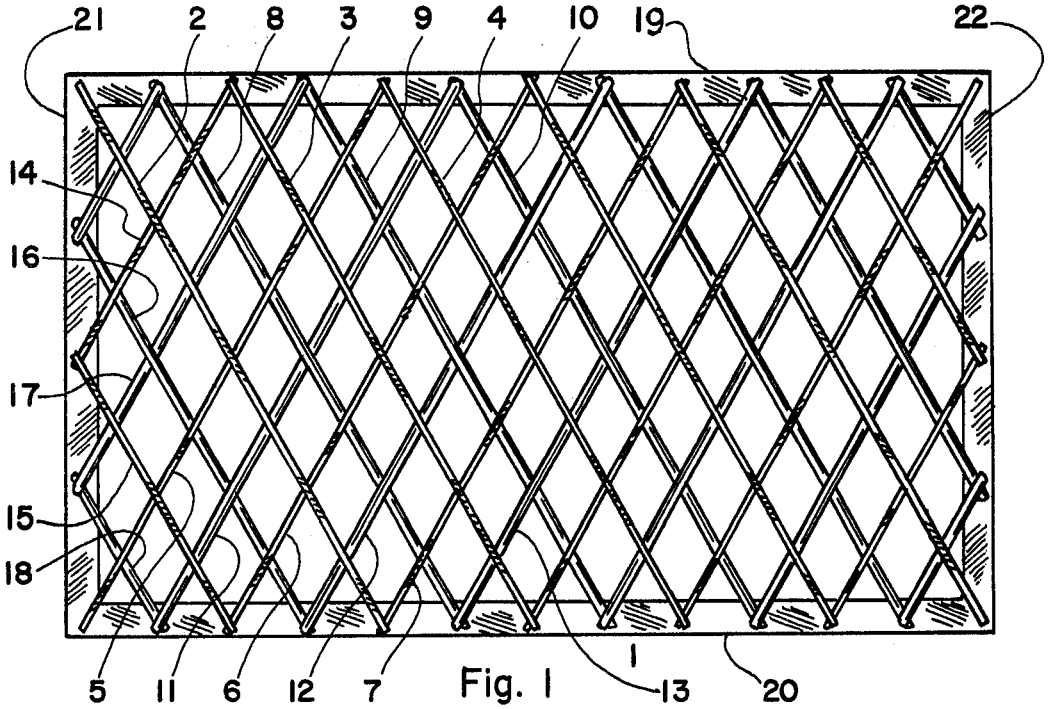
FIG. 1 illustrates a plan view of a curved self-interlocking grille structure constructed in accordance with the principles of the present invention.
Figure 2:
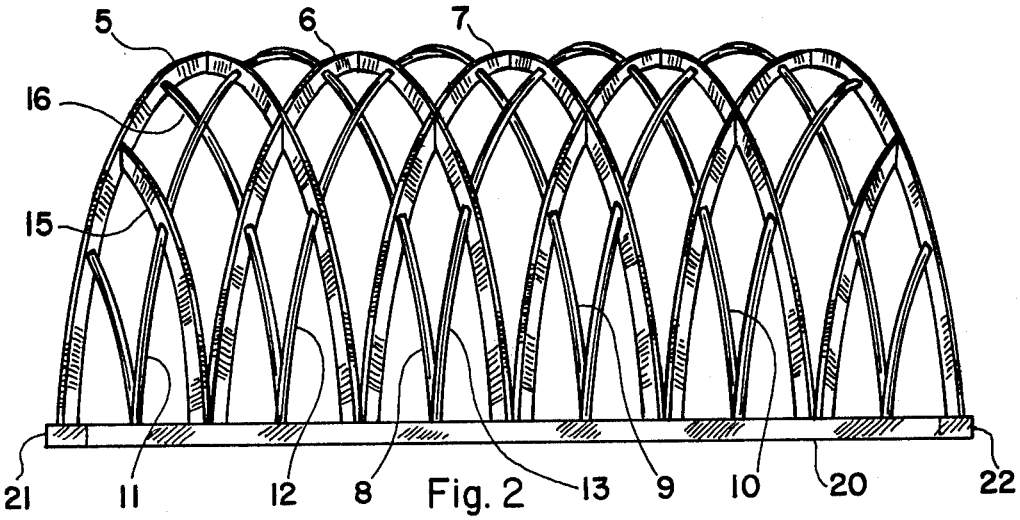
FIG. 2 illustrates an elevation view of the curved self-interlocking grille structure shown in FIG. 1.
Figure 3:
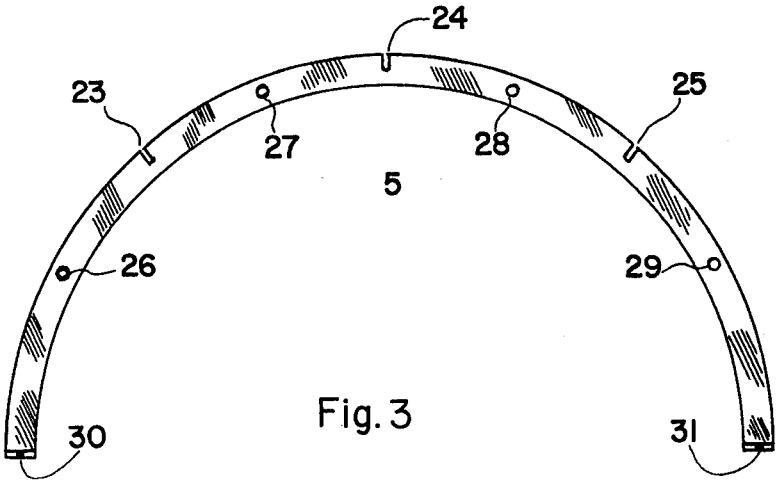
FIG. 3 illustrates the first kind of bars employed in constructing the curved self-interlocking grille structure shown in FIGS. 1 and 2.
Figure 4:
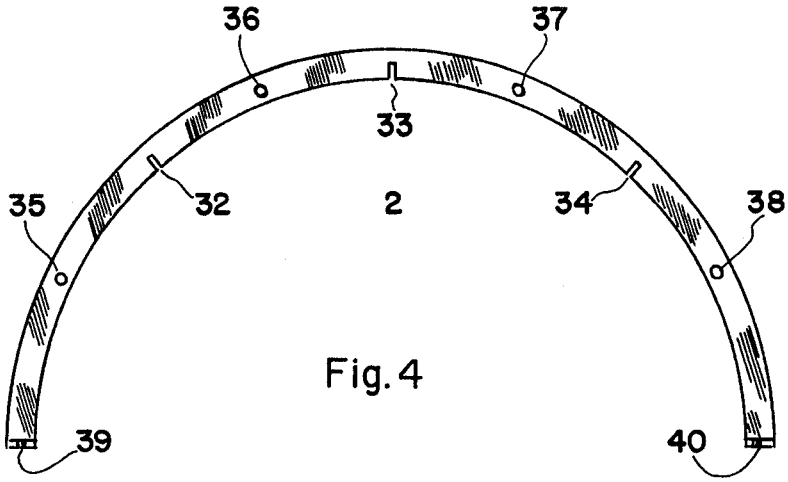
FIG. 4 illustrates the second kind of bars employed in constructing the curved self-interlocking grille structure shown in FIGS. 1 and 2.
Figure 5:
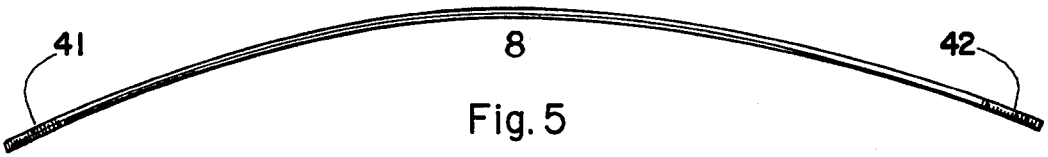
FIG. 5 illustrates the rods employed in constructing the curved self-interlocking grille structure shown in FIGS. 1 and 2.

In FIGS. 1 and 2, there is shown a curved self-interlocking grille 1 constructed in accordance with principles of the present invention, which grille structure has a particular application as a green house, swimming pool cover and other shelters. The geometry of the curved surface is provided by a plurality of the first kind of curved bars 2, 3, 4 etc., and a plurality of curved bars 5, 6, 7 etc., which two different kind of bars are criss-crossed to each other forming a network of bars. The shorter and more tightly curved bars 14 and 15 are employed to construct the end part of the grille shelter structure. As shown in FIGS. 3 and 4, the first kind of bars 5 etc., has a plurality of the notches 23, 24, 25 etc., cut out along the outer perimeter and a plurality of the holes 26, 27, 28, 29 etc., each of which holes is disposed intermediate two adjacent notches. A pair of the anchoring means 30 and 31 are provided at each end of the bar 5, which are used to anchor the bar to a foundation. The second kind of the bar 2 etc. shown in FIG. 4 has a plurality of the notches 32, 33, 34 etc., cutout along the inner perimeter and a plurality of the holes 35, 36, 37, 38 etc., each of which is disposed intermediate two adjacent notches. A pair of the anchoring means 39 and 40 for anchoring said bar to a foundation are provided at each end of said bar. In criss-crossing the first and second kind of the bars to form a network of the bars, each of the notches cutout along the inner perimeter of the second kind of bars 2 is engaged by each of the notches cutout along the outer perimeter of the first kind of the bars 5. So arranged network of the bars provides a series of holes through said bars lined up in the first direction in which direction the first kind of bars are disposed and another series of the holes through said bars lined up in the second direction in which direction the second kind of bars are disposed. Through said holes lined up in two different directions, the rods 8, 9, 10 etc., are threaded in the first direction while the rods 11, 12, 13 etc. are threaded in the second direction wherein the rods threaded in two different directions are inter-woven to each other in criss-crossing each other. The shorter rods 16, 17, 18 etc. are employed to construct the end portion of the grille structure. It should be noticed that the network of the rods are embedded into the network of the bars in an alternating pattern. The ends of the bars and the rods are anchored to the foundation frame including the members 19, 20, 21 and 22. The grille structure assembled in said manner interlocks themselves and, consequently, there is no need of weld or bond connecting the individual members to each other. However, in order to provide an additional strength and rigidity, the individual members criss-crossing each other may be welded or fastened to each other. In order to prestress the grille structure, one may use the rods which are straight or under-curved as shown by the rod 8 in FIG. 5 in assembling the grille structure, which rods are forcibly bent to engage the lined up holes in the network of the bars in threading them through the line-up holes, which creates the prestressing effect on the grille structure and provides an additional rigidity. Both ends of the rod 8 shown in FIG. 5 are provided with the anchoring means 41 and 42 for anchoring to the foundation. It should be understood that when the heavy rods are employed in assembling a grille structure, it may be difficult to forcibly bending them in threading through the line-up hole in the network of the bars. Therefore, the heavy rods must be bent to the right curvature in advance in assembling a grille structure of a heavy weight.

Figure 6:
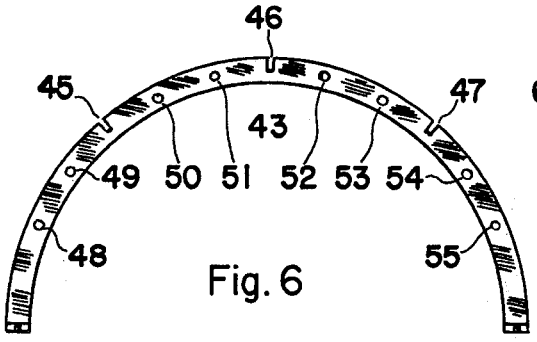
FIG. 6 illustrates another embodiment of the first kind of bars that may be used in place of the first kind of bars shown in FIG. 3.
Figure 7:
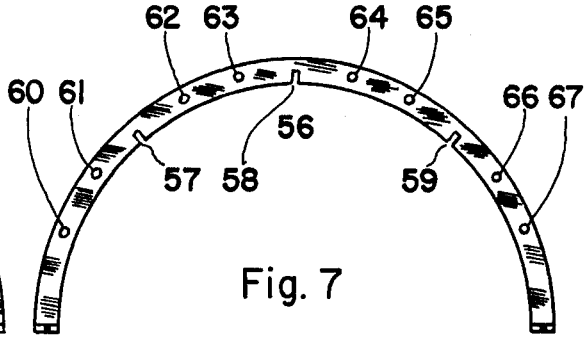
FIG. 7 illustrates another embodiment for the second kind of bars that may be used in place of the second kind of bars shown in FIG. 4.

In place of the first and second kind of bars shown in FIGS. 3 and 4, the first kind of bars 43 shown in FIG. 6 including a plurality of the notches 45, 46, 47 etc. cutout along the outer perimeter and plurality of the pair of the holes 48-49, 50-51, 52-53, 54-55 etc., each of which pairs is disposed intermediate each of two adjacent notches, and the second kind of bars 56 shown in FIG. 7 including a plurality of the notches 57, 58, 59 etc. cutout along the inner perimeter and a plurality of the pair of the holes 60-61, 62-63, 64-65, 66-67 etc., each of which pairs is disposed intermediate each of two adjacent holes, may be employed in constructing a curved self-interlocking grille resembling that shown in FIGS. 1 and 2, wherein a pair of rods are disposed between each of every adjacent pairs of the bars in contrast to single rods between each of two adjacent bars as shown in FIGS. 1 and 2.

Figure 8:
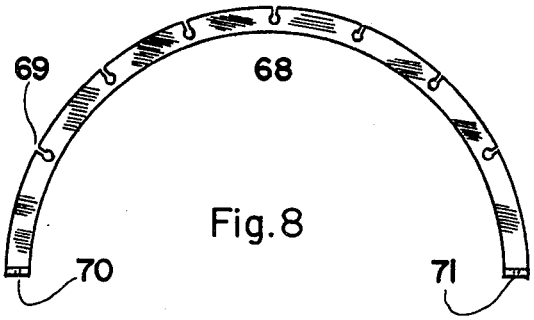
FIG. 8 illustrates the first kind of bars employed in constructing another embodiment of the curved self-interlocking grille.
Figure 9:
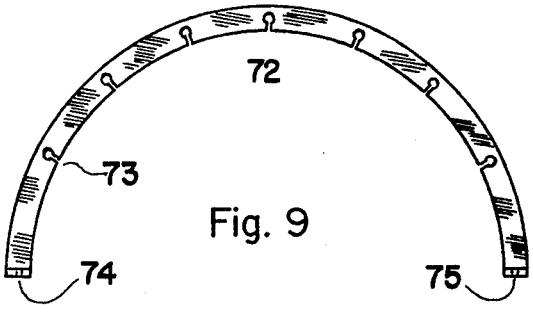
FIG. 9 illustrates the second kind of bars employed in constructing another embodiment of the curved self-interlocking grille.
Figure 10:
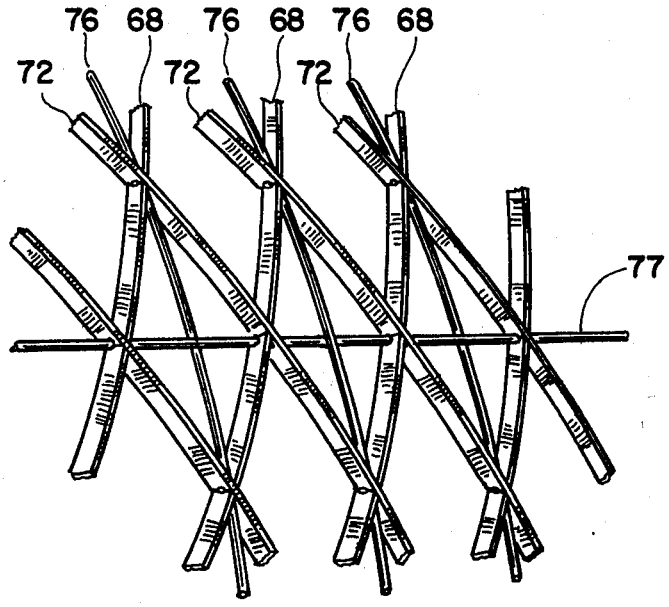
FIG. 10 illustrates another emboiment of the curved self-interlocking grille that employs the first and second kind of bars shown in FIGS. 8 and 9 and the rods.
Figure 11:
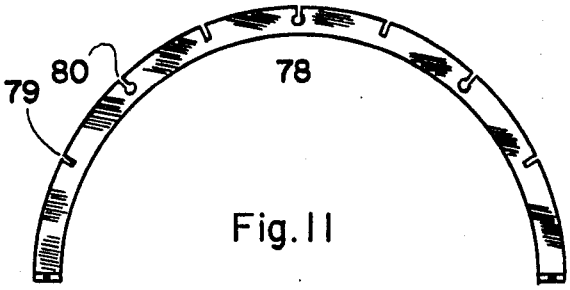
FIG. 11 illustrates a further embodiment of the bars that may be used in place of the bars shown in FIG. 8.
Figure 12:
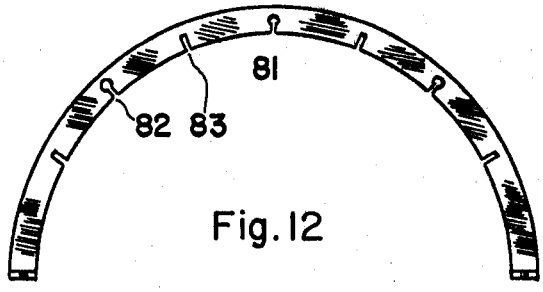
FIG. 12 illustrates a further embodiment of the bars that may be used in place of the bars shown in FIG. 9.

In FIGS. 8 and 9, there are shown a further embodiments for the first and second kind of bars 68 having a plurality of the button hole shaped cutouts 69 disposing along the outer perimeter and the anchoring means 70 and 71, and bars 72 including a plurality of the button hole shaped cutouts 73 disposed along the inner perimeter and the anchoring means 74 and 75, which combination of the first and second kind of bars are used to construct the curved self-interlocking grille shown in FIG. 10 wherein the network of the rods imbedded into the network of the bars include a plurality of rods 76 disposed in the circumferential direction and a plurality of rods 77 disposed in the axial direction. It is not difficult to realize that the grille structure shown in FIG. 10 can be easily modified by eliminating all or every second rods disposed in the axial direction, or by eleminating all or every second rods disposed in the circumferential direction. Such a modified grille structure employing only the every second rods disposed in the axial or circumferential direction may be constructed by using the first kind of bars 78 including a plurality of the notches 79 and a plurality of the button hole shaped cutouts 80 disposed in an alternating pattern along the outer perimeter as shown in FIG. 11, and the second kind of bars 81 including a plurality of the notches 82 and a plurality of the button hole shaped cutouts 83 disposed along the inner perimeter in an alternating pattern as shown in FIG. 12.

Figure 13:
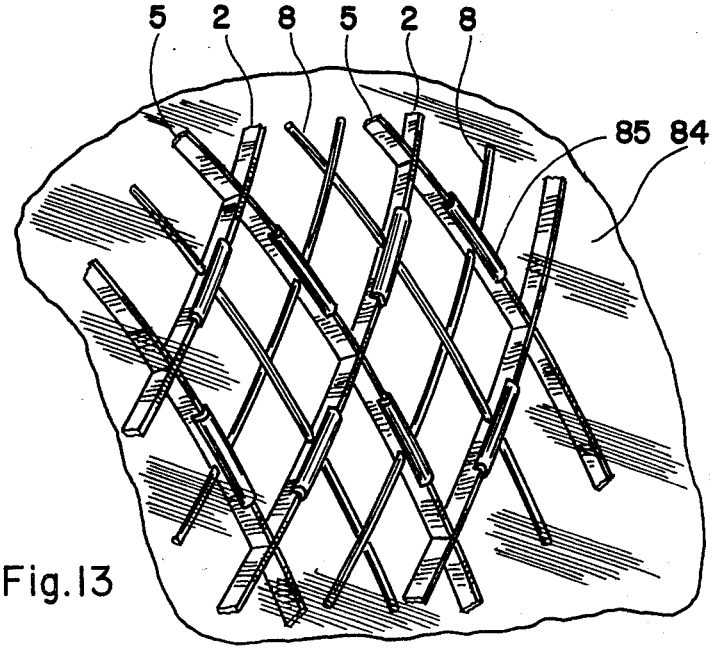
FIG. 13 illustrates a transparent skin attached to a curved self-interlocking grille by means of a plurality of clips.

In FIG. 13, there is shown a curved self-interlocking grille comprising the first and second kind of bars 5 and 2 and the rods 8, to which grille assembly a transparent skin 84 is attached by means of a plurality of the clips 85 clipped onto the ridge of said first and second kind of bars, which clips hold down the transparent skin on to the ridge of the bars by the squeezing action.

Figure 14:
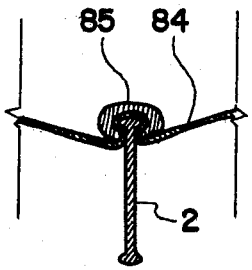
FIG. 14 illustrates the cross section of a bar comprising a curved self-interlocking grille as shown in FIG. 13, to which bar a clip is clipped on to hold down the transparent skin.

In FIG. 14, there is shown a cross section view of the bar 2 with a clip 85 clipped on which holds down the transparent skin 84. The bar 2 is provided with a pair of enlarged section at each of both ridges acting as a detent in retaining the clip 85 in place. In general, the bars constituting the grille system may be provided with a cross section of one of many structural shape for the strength as well as other additional geometry such as the means for retaining the clips or for accepting the panels attached to said grille structure. It is easy to realize from FIG. 14 that another skin may be attached to the grille system on the inner side by using the same clips as those employed on the outside. Such a double skin arrangement provides an advantage in cutting down the heat transfer across the grille structure.

While the principles of the invention have now been made clear by the illustrative embodiment, there will be immediately obvious to those skilled in the art many modifications of structures, arrangement, proportions, elements, materials and components used in the practice of the invention which are particularly adapted for specific environment and operating requirement without departing from those principles.

I claim:

1. The curved shelter comprising in combination:

(a) a plurality of first kind of bars having first and second edges, each of which bars including a plurality of cutouts disposed along said first edge of said bars and further including one or more holes disposed intermediate each of two adjacent said cutouts, said bars curved to conform with a required surface geometry and disposed in a first direction;

(b) a plurality of second kind of bars having first and second edges, each of which bars including a plurality of cutouts disposed along the said second edge of said bars and further including one or more holes disposed intermediate each of two adjacent said cutouts, said bars curved to conform with a required surface geometry and disposed in a second direction criss-crossing said plurality of first kind of bars wherein each of said cutouts on said first kind of bars engages each of said cutouts on said second kind of bars; whereby, said pluralities of first and second kind of bars are assembled into a network of bars providing a plurality of series of said holes on said first and second kind of bars lined up in said first and second directions;

(c) a plurality of rods threaded through said plurality of series of holes lined up in said first and second directions;

(d) a flexible covering stretched over said network of bars; and (e) a plurality of clips of U-shaped cross section clipped onto the edges of said first and second kind of bars holding down said flexible covering to said network of bars by the squeezing action.

2. The combination as set forth in claim 1 wherein said plurality of rods threaded through said plurality of series of holes lined up in said first direction are woven to said plurality of rods threaded through said plurality of series of holes lined up in said second direction.

3. The curved shelter structure comprising in combination:

(a) a plurality of first kine of bars having first and second edges, each of which bars including a plurality of cutouts disposed along said first edge of said bars and further including a plurality of holes, each of said holes being disposed at and open to the closed end of each of said cutouts, said bars curved to conform with a required surface geometry and disposed in a first direction;

(b) a plurality of second kind of bars having first and second edges, each of which bars including a plurality of cutouts disposed along the said second edge of said bars and further including a plurality of holes, each of said holes being disposed at and open to the closed end of each of said cutouts, said bars curved to conform with a required surface geometry and disposed in a second direction crisscrossing said plurality of first kind of bars wherein each of said cutouts on said second kind of bars; whereby, said pluralities of first and second kind of bars are assembled into a network of bars providing a first and second series of said holes on said first and second kind of bars lined up in a third direction and a fourth direction;

(c) a first rods threaded through said plurality of series of holes lined up in said third direction;

(d) a flexible covering stretched over said network of bars; and (e) a plurality of clips of U-shaped cross section clipped onto the edges of said first and second kind of bars holding down said flexible covering to said network of bars by the squeezing action.

4. The combination as set forth in claim 3 wherein a plurality of rods are threaded through said second series of holes lined up in said fourth direction.

5. The combination as set forth in claim 4 wherein said first rods threaded through said second series of holes lined up in said third direction and said plurality of rods threaded through said plurality of series of holes lined up in said fourth direction are woven to each other.

* * * * *